US012227962B1

(12) United States Patent
Saia

(10) Patent No.: US 12,227,962 B1
(45) Date of Patent: Feb. 18, 2025

(54) APPARATUS, SYSTEM AND METHOD FOR ASSEMBLING, ALIGNING, LEVELING AND SQUARING IN-GROUND POOL WALLS

(71) Applicant: Shane L. Saia, Silver Lake, KS (US)

(72) Inventor: Shane L. Saia, Silver Lake, KS (US)

( * ) Notice: Subject to any disclaimer, the term of this patent is extended or adjusted under 35 U.S.C. 154(b) by 0 days.

(21) Appl. No.: 17/717,692

(22) Filed: Apr. 11, 2022

Related U.S. Application Data

(63) Continuation of application No. 16/746,746, filed on Jan. 17, 2020, now Pat. No. 11,299,897.

(60) Provisional application No. 62/793,540, filed on Jan. 17, 2019.

(51) Int. Cl.
*E04H 4/14* (2006.01)
*E04H 4/00* (2006.01)

(52) U.S. Cl.
CPC ..... *E04H 4/14* (2013.01); *E04H 4/0043* (2013.01)

(58) Field of Classification Search
CPC ..... E04H 4/14; E04H 4/0043; F16B 31/021
USPC ..... 52/169.7; 411/3
See application file for complete search history.

(56) References Cited

U.S. PATENT DOCUMENTS 2,680,326 A * 6/1954 Sultan ..... A47B 91/024 248/188.4
3,335,532 A * 8/1967 Greenbie ..... E04B 2/821 52/143
3,408,781 A * 11/1968 Pollock ..... E04B 2/825 52/745.11
3,416,165 A * 12/1968 Pereira ..... E04H 4/142 52/169.8
3,667,339 A * 6/1972 Dame ..... F16B 31/021 411/4

(Continued)

FOREIGN PATENT DOCUMENTS

CA 2591022 A1 * 11/2008 ..... E04H 4/0043
CA 2538515 C * 12/2010 ..... E04H 4/0043

(Continued)

OTHER PUBLICATIONS

EP 0833067 A1 to Ortmann Andreas [DE] Apr. 1, 1998 retrieved from https://worldwide.espacenet.com/publicationDetails/biblio?CC=EP&NR=0833067A1&KC=A1&FT=D&ND=3&date=19980401&DB=EPODOC&locale=en_EP (Year: 2024).*

*Primary Examiner* — Brian D Mattei
*Assistant Examiner* — Joseph J. Sadlon
(74) *Attorney, Agent, or Firm* — Wilkinson Law Office; Clinton H. Wilkinson

(57) ABSTRACT

An apparatus and system for assisting in assembling, aligning, and leveling the wall panels of an inground swimming pool, the apparatus comprising an adjustment member having an externally threaded shaft section, an internally threaded fastener which is rigidly attached in a hole in a bottom flange of a wall panel, and a cleat member which is adjustably connected under the bottom flange such that the wall panel can be supported on the cleat member, whereby the wall panel can be raised or lowered as needed during assembly, alignment, and leveling of the pool wall by rotatably adjusting the position of the adjustment member, whereby the tensile strength of the threaded shaft is less than that of the threaded aperture in the cleat member such that an area of the threads on the threaded shaft section spaced from the end of the shaft section are intentionally fractured or damaged, preventing prevent the cleat member becoming disengaged from the panel.

20 Claims, 12 Drawing Sheets

(56) References Cited

U.S. PATENT DOCUMENTS 3,874,005 A * 4/1975 Badon ..... A47D 13/06 4/495
3,883,120 A * 5/1975 Tippmann ..... A63C 19/10 256/25
3,979,864 A * 9/1976 Tillie ..... E04C 2/041 52/745.1
RE29,936 E * 3/1979 Arp ..... E04H 4/0043 52/602
4,260,005 A * 4/1981 Stencel ..... F16B 39/00 411/416
4,449,876 A * 5/1984 Glanton ..... B61D 45/001 410/151
4,571,907 A * 2/1986 DeFouw ..... A47B 83/001 52/239
4,589,237 A * 5/1986 Dahowski ..... E04H 4/144 52/741.2
4,662,806 A * 5/1987 Reed ..... B23P 6/04 411/2
4,744,187 A * 5/1988 Tripp ..... F16B 37/14 52/410
4,752,171 A * 6/1988 Pliml, Jr. ..... B29C 65/069 411/181
4,914,875 A * 4/1990 Gustafson ..... E04B 1/34352 52/126.6
5,033,242 A * 7/1991 Borbely ..... E04F 15/02429 52/126.5
5,228,250 A * 7/1993 Kesselman ..... F16B 31/021 411/910
5,230,191 A * 7/1993 Mayrand ..... B28B 7/0088 52/331
5,713,705 A * 2/1998 Grunbichler ..... F16B 31/021 411/910
5,772,252 A * 6/1998 Malani ..... F16L 25/065 411/389
5,906,075 A * 5/1999 Sowers ..... E04H 1/02 52/79.8
5,953,867 A * 9/1999 Colletto ..... E04H 4/142 4/506
6,004,217 A * 12/1999 Johnston ..... A63C 19/10 472/92
6,295,771 B1 * 10/2001 Desjoyaux ..... E04H 4/0043 52/568
6,367,099 B1 * 4/2002 Contrino ..... E04H 4/005 52/762
6,643,858 B2 * 11/2003 Lee ..... E04H 4/0056 4/506
6,729,099 B2 * 5/2004 Hazama ..... E04G 15/04 411/3
6,889,477 B1 * 5/2005 Kottman ..... E04B 2/7422 52/64
7,877,960 B2 * 2/2011 Kennedy ..... E04C 2/384 52/592.1
8,028,476 B1 * 10/2011 Alford ..... E04H 4/0043 248/188.2
8,181,405 B2 * 5/2012 Nash ..... E04F 11/1851 52/800.18
8,636,020 B2 * 1/2014 Li ..... A45B 25/14 135/912
8,656,655 B2 * 2/2014 Thiessen ..... B65D 90/24 52/169.8
8,726,582 B2 * 5/2014 Hahin ..... F16B 31/021 403/186
8,739,490 B2 * 6/2014 Weber ..... E04B 2/44 52/564
8,875,368 B2 * 11/2014 O'Sullivan ..... F16B 31/021 411/2
8,888,415 B2 * 11/2014 Ikuno ..... F16B 31/021 405/259.4
9,259,372 B2 * 2/2016 Steinman ..... A61G 7/1005
10,288,106 B2 * 5/2019 Lemacks ..... F16B 37/044
10,422,367 B2 * 9/2019 Graham ..... F16B 19/008
10,501,939 B2 * 12/2019 Nill ..... E04D 13/00
11,092,185 B2 * 8/2021 Peltier ..... F16B 31/021
11,612,240 B1 * 3/2023 Kincaid ..... A47B 81/06 248/682
2005/0284042 A1 * 12/2005 Spedini ..... E04H 4/0056 52/169.7
2009/0165201 A1 * 7/2009 Vultaggio ..... E04H 4/142 33/365
2011/0268526 A1 * 11/2011 Wu ..... F16B 13/143 29/525.12
2015/0023753 A1 * 1/2015 Dostinov ..... F16B 39/30 411/2
2016/0237703 A1 * 8/2016 Deason ..... E04G 13/06
2017/0044787 A1 * 2/2017 di Girolamo Pe .... F16B 5/0225
2019/0162222 A1 * 5/2019 Vovan ..... F16B 19/1072
2019/0177973 A1 * 6/2019 Mitrovic ..... E04H 4/14
2019/0194948 A1 * 6/2019 Nill ..... E04D 13/00
2020/0166068 A1 * 5/2020 Sailer ..... F16B 31/021

FOREIGN PATENT DOCUMENTS

CA 2829443 A1 * 4/2015 ..... E04H 4/0087
CN 108360855 A * 8/2018
FR 2482221 A * 11/1981 ..... E04H 17/14
FR 2992013 A1 * 12/2013 ..... E04H 4/0043
GB 2074854 A * 11/1981 ..... E04H 4/142
GB 2183472 A * 6/1987 ..... E04H 4/145
GB 2372476 A * 8/2002 ..... B23K 33/00
WO WO-03067102 A1 * 8/2003 ..... F16B 31/021
WO WO-2006005034 A2 * 1/2006 ..... A61G 7/1005

* cited by examiner

APPARATUS, SYSTEM AND METHOD FOR ASSEMBLING, ALIGNING, LEVELING AND SQUARING IN-GROUND POOL WALLS

CROSS REFERENCE TO RELATED APPLICATION

This application claims the benefit of U.S. Provisional Application No. 62/793,540 filed on Jan. 17, 2019, and U.S. application Ser. No. 16/746,746 filed on Jan. 17, 2020, the entirety of which is hereby incorporated by reference.

FIELD OF THE INVENTION

The present invention relates generally to swimming pool wall construction, and more particularly to an apparatus, system and method which aids contractors in assembling, aligning, leveling, and squaring the wall panels of in-ground swimming pools during pool construction.

BACKGROUND OF THE INVENTION

In-ground swimming pool kits are gaining in popularity as they contain all of the necessary structural parts to build a desired pool configuration in a single package, including the wall panels, bracing material, stakes, treads, risers, liner, and other components and accessories such as a heater, pumps and filters. To install an in-ground pool, the ground area where the pool is to be located is marked up and excavated to a slightly greater depth and general perimeter configuration of the pool. The pool wall is typically formed of a plurality of individual galvanized steel or polymer flanged panel sections, although some more expensive custom pools may use cement or block. The panel sections are arranged in an upright side-by-side relation on a shelf area formed around the perimeter of the excavated ground. The panels have their smooth front surfaces aligned facing inwardly and are secured together along adjacent vertical side flanges to form the pool interior side wall. This step alone normally requires at least two workers acting in a coordinated manner. The bracing material, which may be an adjustable A-frame bracing, is attached to the flanges along the rear or outwardly facing surfaces of the panels. Once assembled and properly positioned, the bracing and panels are secured in place by passing rebar through holes in the lower panel flanges and bracing into the shelf area. The panels must also be squared and aligned, and then leveled, after which the panels are permanently set in position with a cement footing. Once the walls have been set, the pool bottom is "floated" using an approved pool base material such as cement, vermiculite, or sand. A backfill material is used to fill behind the rear surface of the walls, and a pool liner is installed over the wall panels and bottom.

Although swimming pool kits greatly simplify the construction process, installing an in-ground pool nevertheless remains a laborious and expensive task. In particular, assembling the pool wall requires several connecting bolts to be secured in aligned apertures in the side flanges of adjacent wall panel sections, which also requires that the side flanges be flush and accurately aligned. Squaring the wall panel sections prior to pouring the concrete footing often requires certain panels to be repositioned laterally, which can be difficult since the weight of the panels causes the bottom plate or flange to dig into the supporting shelf, such that the panel will not simply slide over the shelf surface. In addition, once the wall panels are secured together, ensuring that they are horizontally level around the entire perimeter of the pool can be one of the more challenging steps of the installation process. A transit level may be used to identify non-level areas. Conventionally, leveling is performed by locating the highest point on the wall, identifying any lower panel sections, and then raising the lower wall panel sections to the same level as the highest point using a prybar. One or more shims is inserted between the bottom of the wall panel and the shelf area to maintain the panels at the desired height. This process can be very time consuming and is not very accurate. In addition, the shims which are typically made of wood tend to become compressed over time. There therefore remains a need for a less laborious, less time consuming, and less expensive system for assembling, aligning, leveling, and squaring adjacent interconnected in-ground pool wall panels prior to final positioning.

BRIEF SUMMARY OF THE INVENTION

The present invention is an in-ground swimming pool wall panel assembly, alignment, leveling, and squaring system. The present system is utilized both during assembly of the pool wall as an aid in interconnecting adjacent pool wall sections or panels comprising the pool wall, and also during leveling of the panels to ensure that the top surfaces of the interconnected pool wall sections or panels are both level and square, as follows. The system can be used with all standard sized straight pool wall panels, which are normally provided in 2-foot, 3-foot, 4-foot, 5-foot, 6-foot, 7-foot and 8-foot sections, and all curved panels. Pool wall panels, such as those included in an in-ground pool kit, may be made of galvanized steel or a polymer and have a smooth, rigid main body section, and pairs of opposite end wall and upstanding side wall flanges, each disposed at a 90 degree angle with respect to the main body section. The side flanges are provided with a series of similarly positioned predrilled holes for bolting adjacent panels together in a side-by-side relation. The end flanges are also provided with similarly positioned predrilled holes near the ends of the flanges such that the panels may be set in a pool hole with either end flange facing downwardly. In an embodiment, the holes are sized to allow a ⅜th or ½ inch steel rebar to be selectively passed through one or more of the holes on the bottom facing end plate into the pool shelf area when the panels are assembled, and after the panels have been aligned and squared, to prevent the panels from bowing in or out or moving laterally. Once the assembly, alignment, leveling, and squaring system of the present invention is applied to one of the end flanges, this end flange becomes the bottom flange of the panel.

The alignment, assembly, leveling, and squaring system of the present invention includes three primary components; a threaded level adjustment member, an internally threaded fastener, and a shoe or cleat member. In an embodiment, the adjustment member is a threaded bolt, and in some embodiments the level adjustment member has a bolt diameter of ⅜th inches, a 9/16th inch bolt head, and a bolt shaft length of 6 inches with SAE standard threads extending all the way to the head. In some embodiments, the adjustment member is a low or medium grade carbon steel bolt with a grade 5 or less, and preferably with a grade 2 or 3 so the threads will strip faster on the collar portion of the shoe or cleat member during implementation of the invention in the manner to be described. In some embodiments, the internally threaded fastener is a ⅜th inch fastener with SAE standard internal threads which is secured in one of the holes in the lower flange of the pool wall panels. The shoe or cleat member in an embodiment is formed of a steel plate which in an embodiment is 5 by 5 inches and has a thickness of 3/16th inches or less, and also having a cavity centered in a side wall of the steel plate which is about 1½ to 2 inches wide by ½ inch deep and which forms a cleat on the underside of the shoe or cleat member. A collar portion is secured such as by tack welding over the open mouth of the cavity, and an aperture which in an embodiment is a ⅜th inch aperture is provided in the collar portion for threadably passing the shaft of the level adjustment member into the cavity, the collar being formed of metal having the same or a thinner gauge (i.e., same or lesser strength/thickness) than the plate.

An internally threaded fastener is secured in one of the predrilled holes on the bottom flange of each of the wall panels, either during manufacture of the panels or by a contractor prior to installation of the panels. In an embodiment, a pair of fasteners is secured to each bottom flange spaced apart and near the opposite side flanges. A level adjustment member is threadably connected to each threaded fastener with the threaded shaft extending downwardly through the bottom flange until the lower end of the bolt shaft extends out the lower facing end of the fastener. A shoe or cleat member is then secured to the lower end of the level adjustment member shaft by threadably passing the end of the shaft into the threaded opening in the collar portion of the cleat member, such that the lower end of the shaft now extends into the cavity formed underneath the collar. The level adjustment member is continued to be rotated until the lower end of the shaft is forcibly pressing against the inner bottom wall of the cavity. The level adjustment member is then still further forcibly rotated into contact with the cavity bottom until the external threads on the shaft in contact with the internally threaded collar fail or become stripped, so that the bolt can no longer be threadably removed from the cavity. As a result, the cleat member is effectively secured by the level adjustment member to the bottom flange of the wall panel such that the cleat member will not become accidentally disconnected from the bottom flange while moving or positioning the panel on the pool shelf area. In addition, the shoe or cleat member is able to be tilted or angled in any direction up to about a thirty-degree angle with respect to the bolt member, which facilitates placement of the cleat on nonplanar or uneven ground surfaces. At least two shoe or cleat members are preferably attached to the bottom plate of each of the swimming pool wall panels spaced on opposite ends of the panels.

Once the cleats are secured to the bottom flange of the pool wall panels, each panel is positioned upright on the shelf area of the excavated hole in its designated location to form the pool perimeter wall. The side flanges of the panels have matching apertures through which bolts must be passed to tightly secure adjacent panels together. In order to properly secure adjacent panels together, the panels must be precisely positioned and both horizontally and vertically aligned, with the surfaces of adjacent side flanges flush against each other from top to bottom. Since the ground surface of the pool shelf area on which the panels are supported is rarely completely level, one end of a panel is often slightly lower than an adjacent panel, and/or the panels are not horizontally level. The system of the present invention has been designed to be used to assist in aligning the panels and in securing adjacent side flanges together by enabling one of the panels or a section of a panel to be raised or lowered using an impact wrench to adjust the thread position of the level adjustment member shaft for one of the shoe or cleat members. For example, in some cases when trying to bolt a pair of panels together, the bottom edges of the panel side flanges will be flush, but there may be a gap of an inch or more at the top of the panels. In this case, the opposite end of one of the panels should be raised so as to pivot the upper end of the opposite side flange towards the other panel side flange in order to close the gap at the seam between the panel side flanges. Prior to use of the present invention, shims or the like would have to be placed under the panels, which is a laborious and imprecise activity that requires lifting and holding the panels manually while trying to align the holes in the side flanges at least long enough to pass a bolt member through the holes. Through use of the present invention, however, workers can connect the panels together more easily and faster than is currently possible using traditional installation methods.

After the wall panels have been secured together to construct the pool side wall, the contractor must square and align the wall, which may require the walls to be slid or repositioned laterally on the panel shelf area. The ability to laterally slide the wall panels on the shelf area is also facilitated by the present invention, since the bottom surface of each shoe or cleat is provided with a rounded and smooth surface free of any sharp edges that would otherwise dig into and disrupt the panel shelf area surface and make it very difficult to reposition the panels. The rounded bottom surface of each shoe or cleat not only allows the panels to be more easily slidingly repositioned, but also provides a sufficient contact with the panel shelf ground surface to inhibit further movement or sliding once repositioned. The cleat members are also provided with apertures through which a ⅜th to ½ inch rebar may be passed into the shelf area to secure the cleat, and as a result also the panels, in place once repositioned. The cleat members are also allowed to pivot laterally with respect to the vertically extending bolt, such that individual cleat members can be swiveled to better match the angle of the pool shelf wall surface at a given location.

The pool wall panels can also be leveled utilizing the present invention and system. Using a 9/16th inch socket or a cordless drill or impact wrench, a contractor can raise or lower any point along the pool wall perimeter to a desired level by threadably turning the bolt up or down as its lower end presses against the shoe or cleat, which cleat is pressing against the shelf area ground surface on which the pool wall is being supported. The contractor has approximately a six-inch variance to raise or lower the walls due to use of the six-inch bolt. During adjustment the shoe or cleat will remain connected to the wall panel flange because of the area of pre-stripped threads on the bolt shaft. Once the pool wall has been properly leveled, a cement footing is poured, which will fill in any areas between the bottom plate and the ground surface, permanently securing the walls in a level position.

The presently described system is easy to install and operate and is comprised of three simple component parts that will allow swimming pool contractors to speed up the installation time.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description in conjunction with the accompanying drawings, wherein like reference numerals designate like structural elements, and wherein.

DETAILED DESCRIPTION OF THE INVENTION

Reference will now be made in detail to representative embodiments of the present invention as illustrated in the accompanying drawings. The following descriptions are not intended to be understood in a limiting sense, but to be an example of the invention presented solely for illustration thereof, and by reference to which in connection with the following description and the accompanying drawings one skilled in the art may be advised of the advantages and construction of the invention.

For orientation purposes, it will be understood that where embodiments of the invention are described herein with reference to the Figures using terms such as "front", "rear", "top", "uppermost", "bottom", "length", "height", and other terms of orientation, such terms are referring specifically to the orientation of the embodiments as they are oriented in the Figures, and as the invention would be normally utilized, and should not be construed in any other limiting manner.

Figure 1:
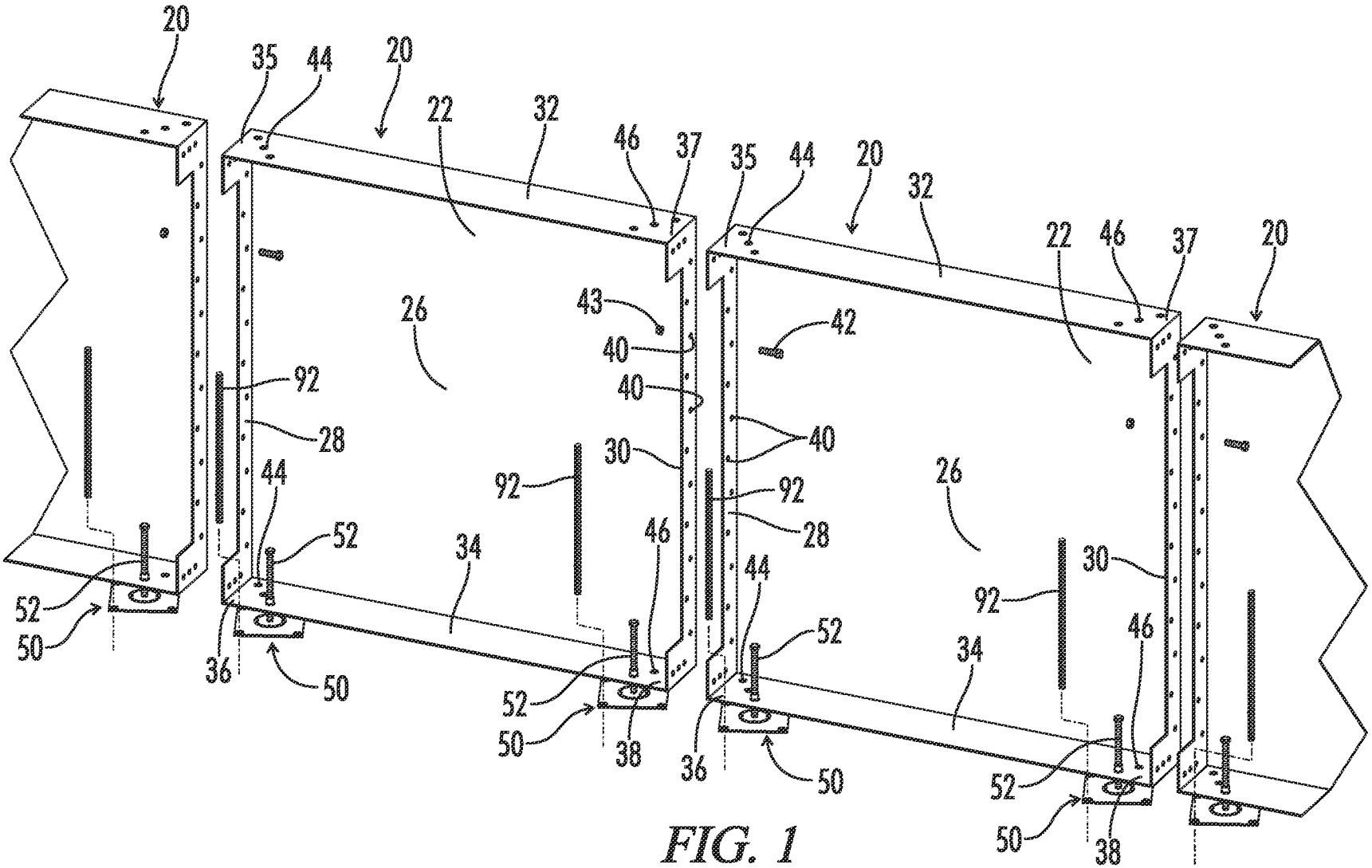
FIG. 1 is a rear perspective view of several swimming pool wall panels incorporating the apparatus and system of the present invention.
Figure 15:
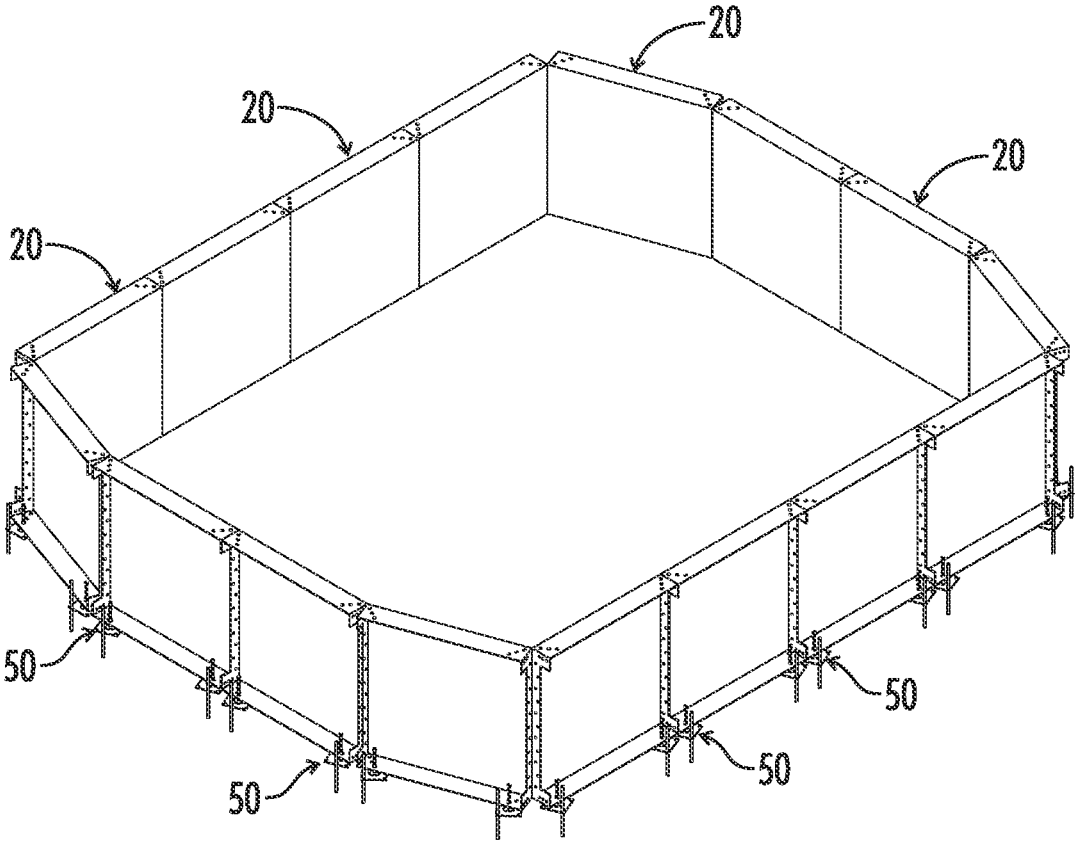
FIG. 15 is a diagrammatic view of an entire pool wall incorporating the system of the present invention.

Referring now to the drawings, FIG. 1 illustrates several upright swimming pool wall panels 20 positioned in a side-by-side relation. It will be understood that for purposes of illustration the panels 20 situated on the ends in FIG. 1 are only partially shown, and that additional panels 20 will be provided which when similarly connected will define a perimeter wall structure for an in-ground swimming pool (FIG. 15). Each of the wall panels 20 in the Figures has been adapted for use with the assembly, alignment, leveling and squaring system 50 of the present invention. It will also be understood that other parts of the pool system such as components required to connect the wall panels at corners and angles are not shown.

Figure 10:
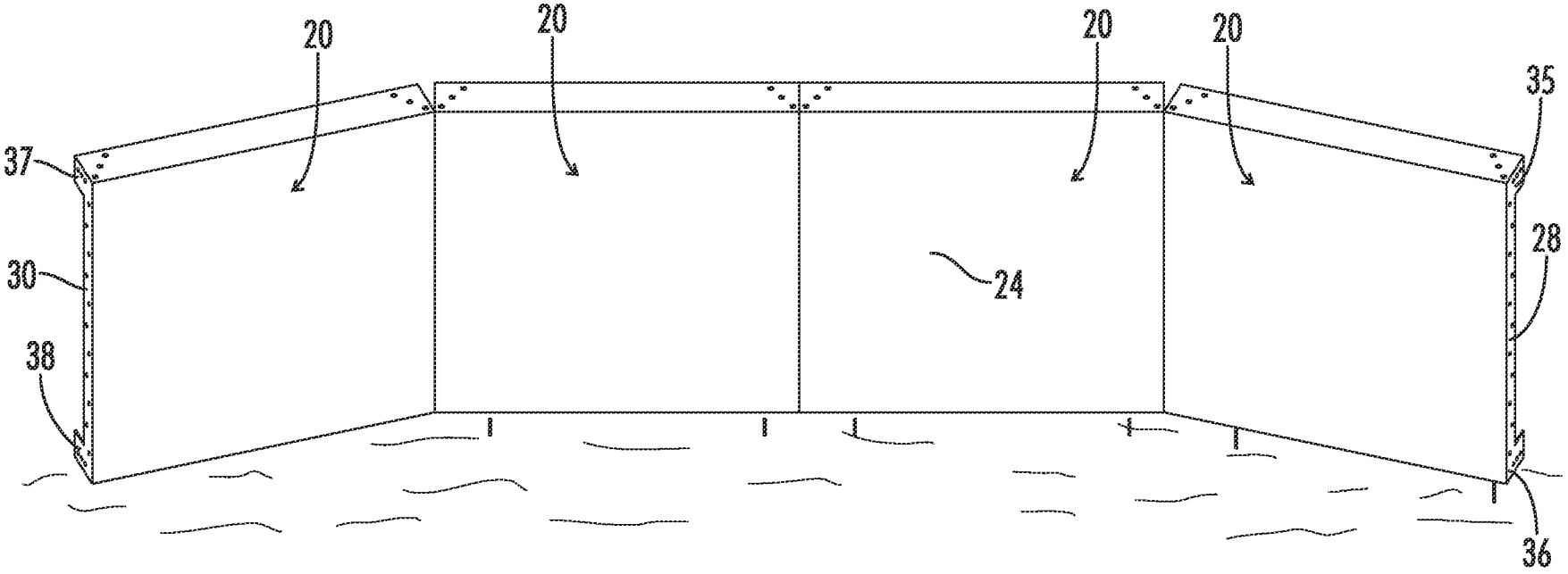
FIG. 10 is a front view of several assembled pool wall panels incorporating the present invention.

Wall panels 20 are made of a suitable material such as, but not limited to, galvanized steel having a rust preventing zinc coating applied, and include a main body section 22 having a smooth front or inwardly (when installed) facing surface 24 (FIG. 10) and an opposite rear or outwardly facing surface 26, which surfaces 24 and 26 are typically but not necessarily vertically planar. Panels 20 also include oppositely disposed side flanges 28 and 30 and top and bottom flanges 32 and 34, each of which extend outwardly from rear surface 26 along a perimeter of main body portion 22, preferably at a right angle. Side flange 28 joins top flange 32 at corner 35 and bottom flange 34 at corner 36, and side flange 30 similarly joins top flange 32 at corner 37 and bottom flange 34 at corner 38, forming a rigid box-like structure around the rearwardly facing surface 26 of main body portion 22 on the panels 20. See also FIG. 11. In an embodiment, side flanges 28 and 30 have a width of about five inches in corners 35, 36, 37, and 38, and a width of about three inches between the corners, and top and bottom flanges 32 and 34 have a width of about five inches.

Figure 2:
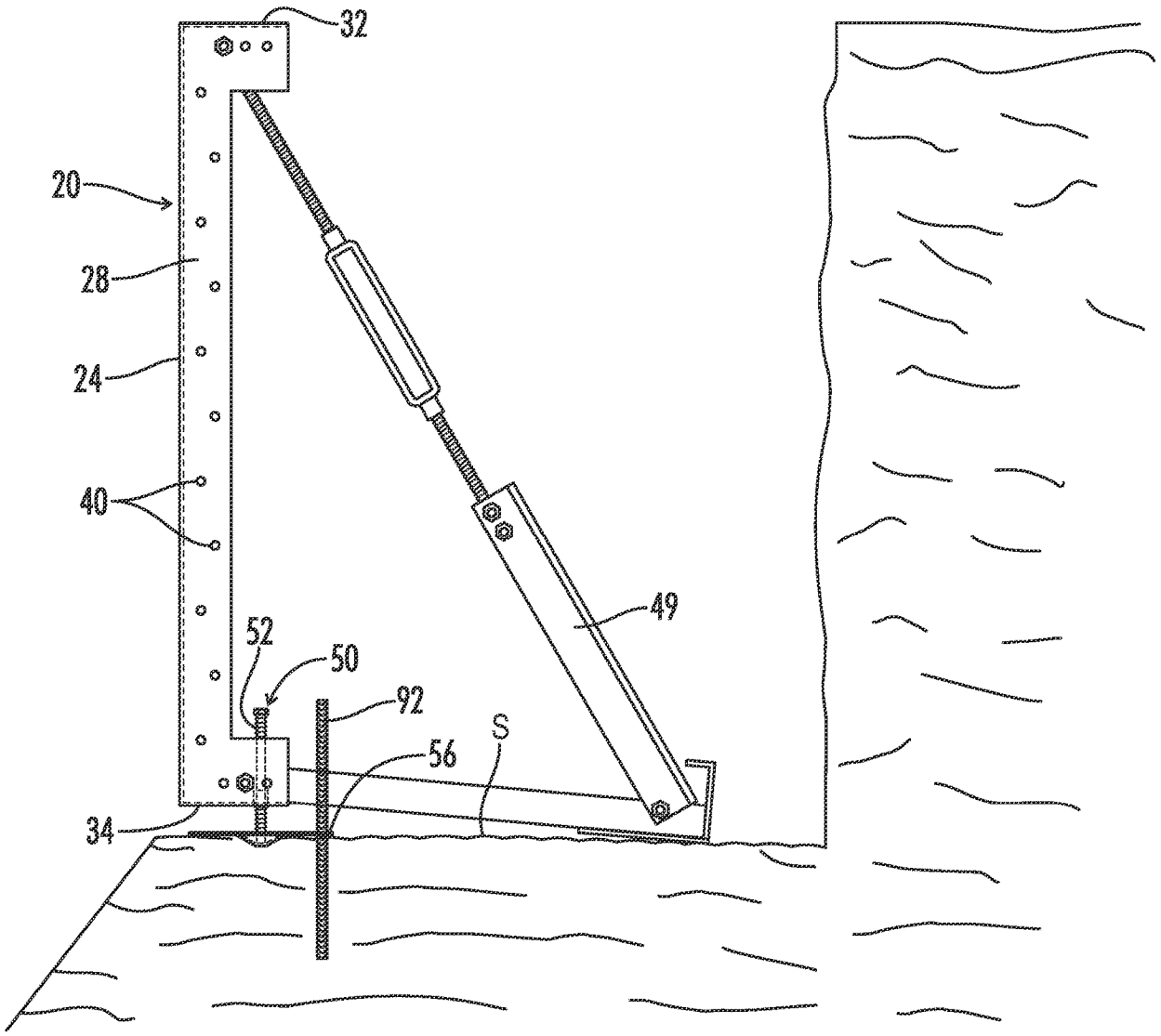
FIG. 2 is a side view of one of the panels shown in FIG. 1 supported on a pool wall shelf including a panel brace.
Figure 11:
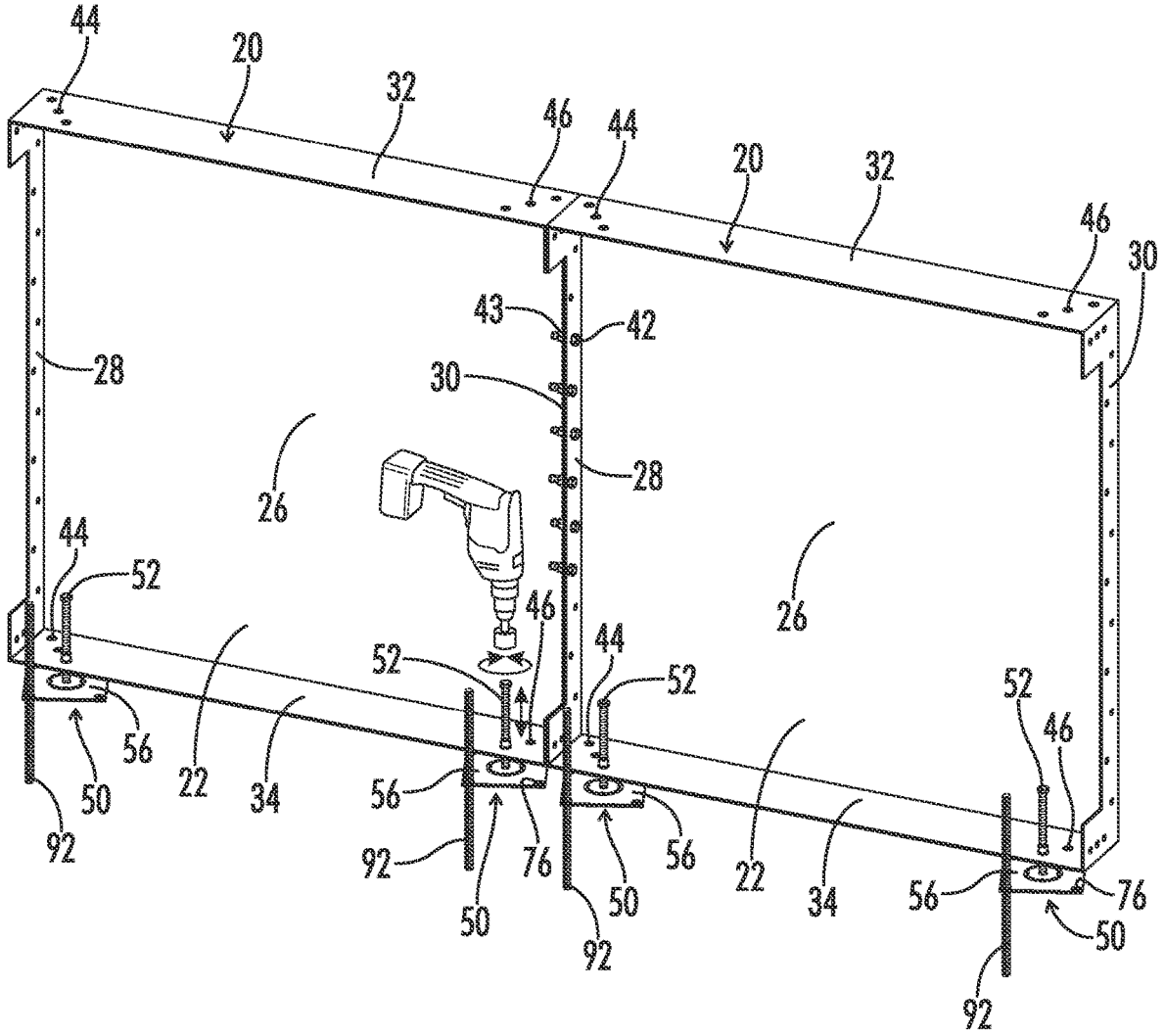
FIG. 11 is an isometric view from the rear of a pair of connected pool wall panels incorporating the present invention.

A plurality of spaced-apart aligned apertures 40 are formed in side flanges 28 and 30 so that adjacent wall panels 20 can be secured together by passing suitable fasteners such as bolts 42 through the aligned apertures 40 and securing the bolts 42 using suitable nuts 43, joining side-by-side panels 20 together as shown in FIG. 11. Several apertures 44 and 46 are also formed in flanges 32 and 34, at least some of which are situated in or near corners 35, 36, 37, 38. In some embodiments, apertures 44 and 46 may be identically positioned on flanges 32 and 34 so the panels 20 can be set in a pool hole with either flange 32 or 34 oriented downwardly, thus simplifying the installation process. Apertures 44 and 46 are sized to receive a ⅜th inch or ½ inch diameter rebar passed through one or more of the apertures 44 and 46 into the excavated pool shelf area S (FIG. 2) to hold the panels 20 in place after each panel has been assembled, aligned, levelled, and squared utilizing the present inventor's system. FIG. 2 also illustrates a standard A-frame panel wall brace 49 of a type commonly used with panels 20, which is connected to the panel 20 behind the rear surface 26 of the panel 20. Although not shown, it will be understood that a plurality of braces 49 will be connected to panels 20 in a spaced apart manner around the entire periphery of the pool wall. Braces 49 increase the stability of the panels 20 and also allow the panels 20 to be straightened after the concrete footing is poured if needed.

Figure 3:
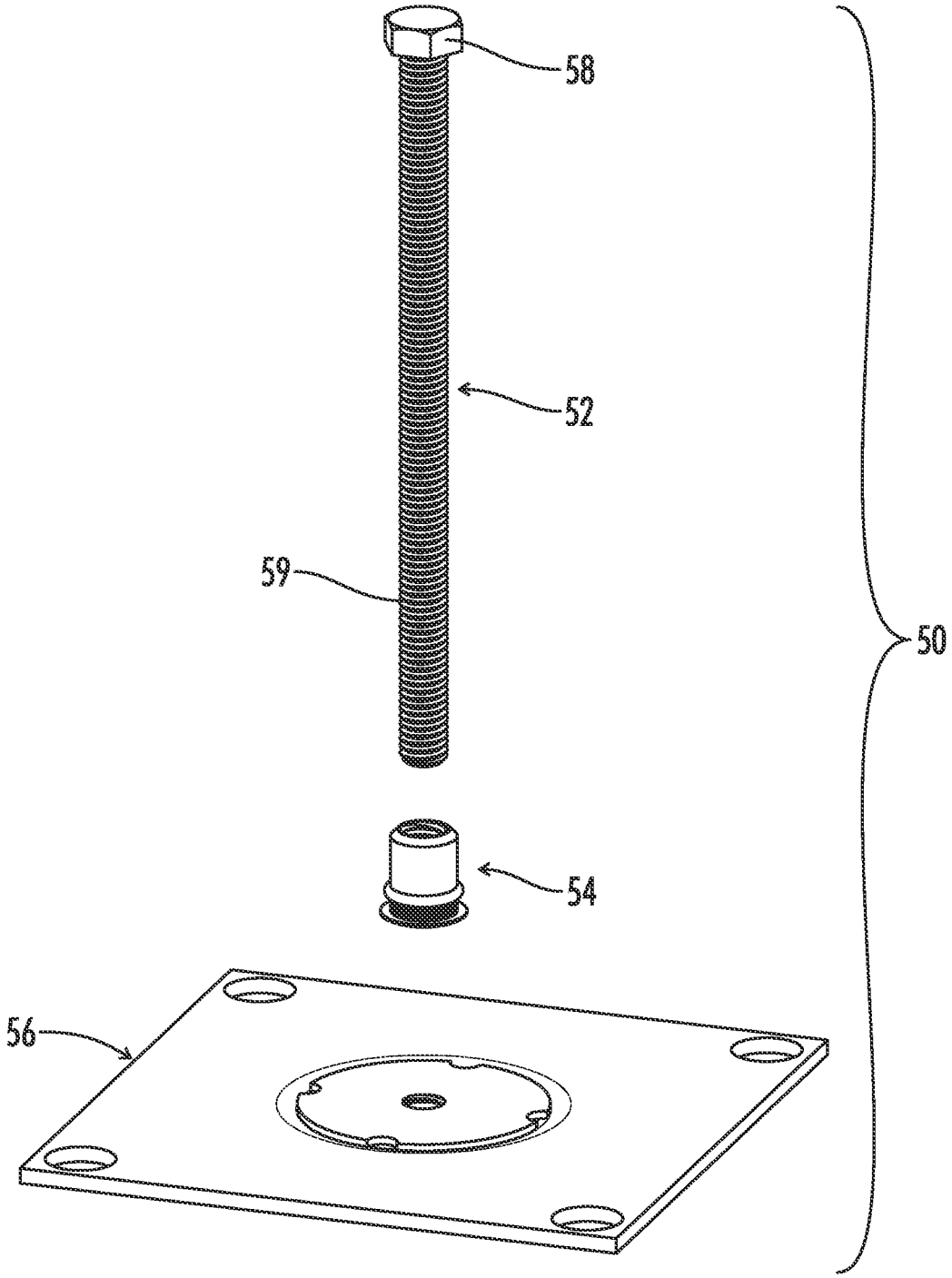
FIG. 3 illustrates component parts of the pool wall panel assembly, alignment, leveling, and squaring apparatus and system of the present invention.

The apparatus comprising the system 50 of the present invention is used in the assembly of pool walls such as shown in FIG. 15 formed of a plurality of individual wall panels 20 aligned in a side-by-side relation, and enables the panels 20 to be more easily and accurately assembled, aligned, squared, and leveled. Referring now in particular to FIG. 3, the inventor's system 50 includes three main component parts; a level adjustment member 52, an internally threaded tubular fastener 54, and a cleat or shoe member 56, which components are utilized in combination in the manner described herein. Level adjustment member 52 in the presently described embodiment may be a bolt member having a head 58 and a threaded shaft section 59. In some embodiments, head 58 has a width of 9/16th inches, and threaded shaft section 59 has a length of 6 inches and a diameter of 3/8th inches, with SAE standard threads extending the entire length of the shaft section 59. In addition, in some embodiments adjustment member 52 is made of a low or medium grade carbon steel bolt with a grade 5 or less, and in other embodiments with a grade 2 or 3. Also, in some embodiments, as will be discussed in greater detail below, adjustment member 52 is made of a carbon steel bolt having a letter grade less than the collar portion 86 of the cleat or shoe member 56.

Figure 4:
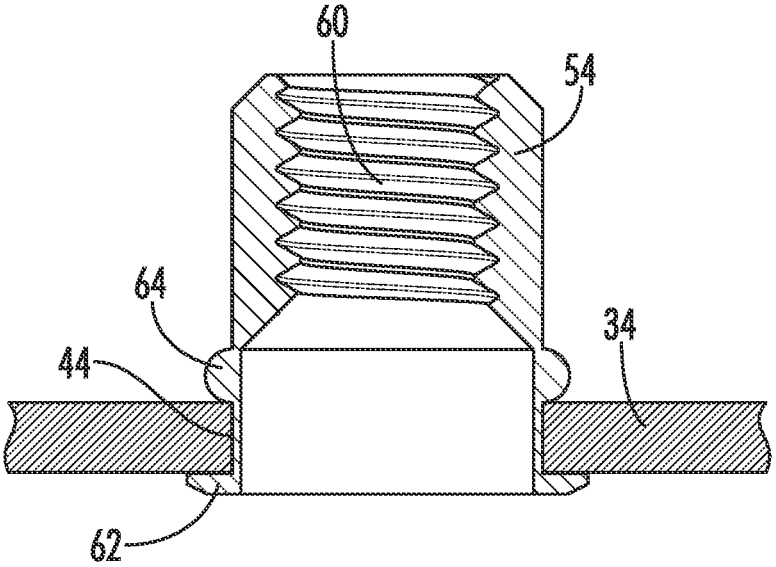
FIG. 4 is a side sectional view of a threaded fastener component.
Figure 7:
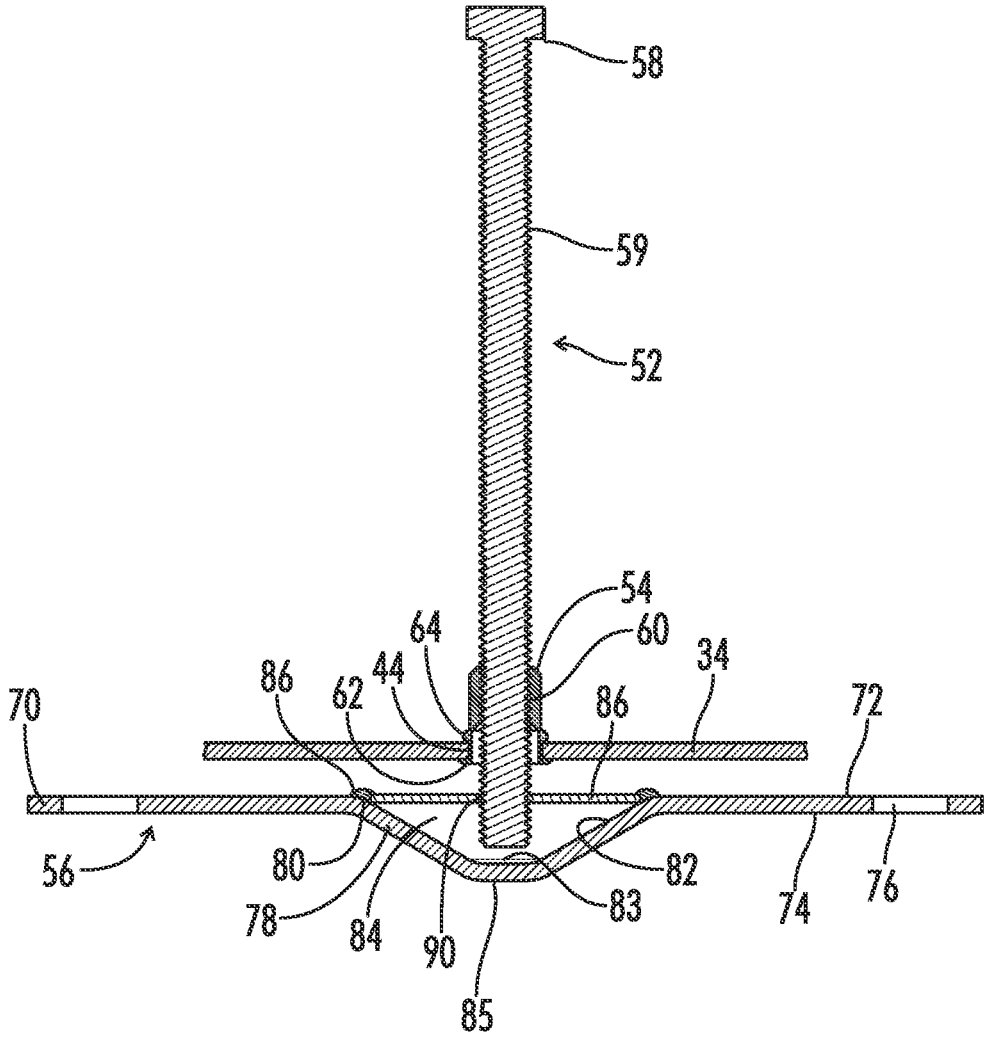
FIG. 7 is side sectional view of the invention secured to a pool wall panel flange.
Figure 8:
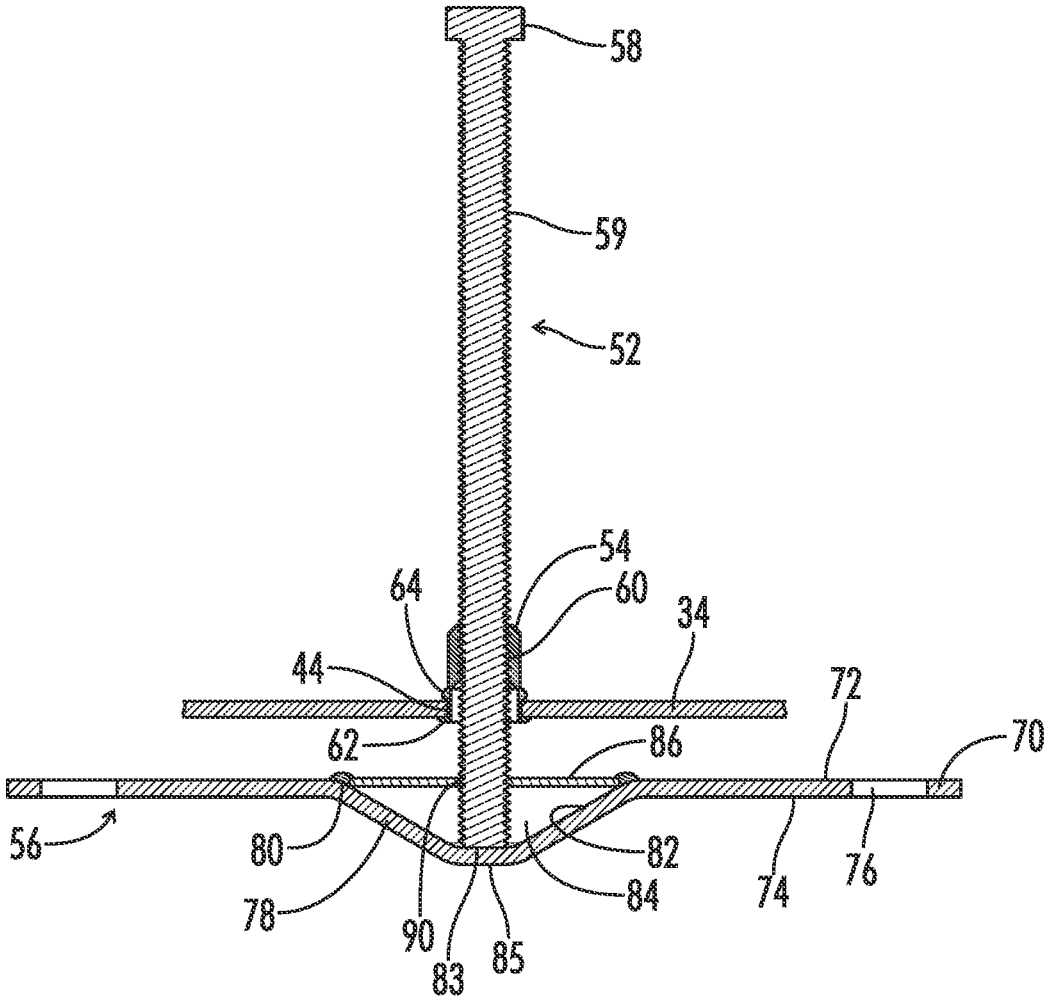
FIG. 8 is a side sectional view as in FIG. 7 showing the pool wall panel flange in a slightly more elevated position.

Referring now in particular to FIGS. 4, 7, and 8, threaded fastener 54 in one embodiment may be a 3/8th inch internally threaded fastener which is secured in one of the apertures 44 or 46 in lower flange 34 of pool wall panels 20. Internally threaded channel 60 of fastener 54 has SAE standard threads and is sized to threadably receive threaded shaft section 59 of level adjustment member 52. In most installations, lower flange 34 of wall panel 20 is made of a thin steel sheet material which is not suitable for threading. Threaded fastener 54 has a lower rim 62 which when the fastener 54 is secured in aperture 44 or 46 fits over the bottom or outwardly facing surface of flange 34 adjacent the aperture, while upper rim 64 similarly extends over the top or inwardly facing surface of flange 34, firmly securing the threaded fastener 54 in aperture 44 or 46. Fastener 54 thus enables the level adjustment member 52 to be threadably secured to flange 34 of the wall panels 20.

Figure 5:
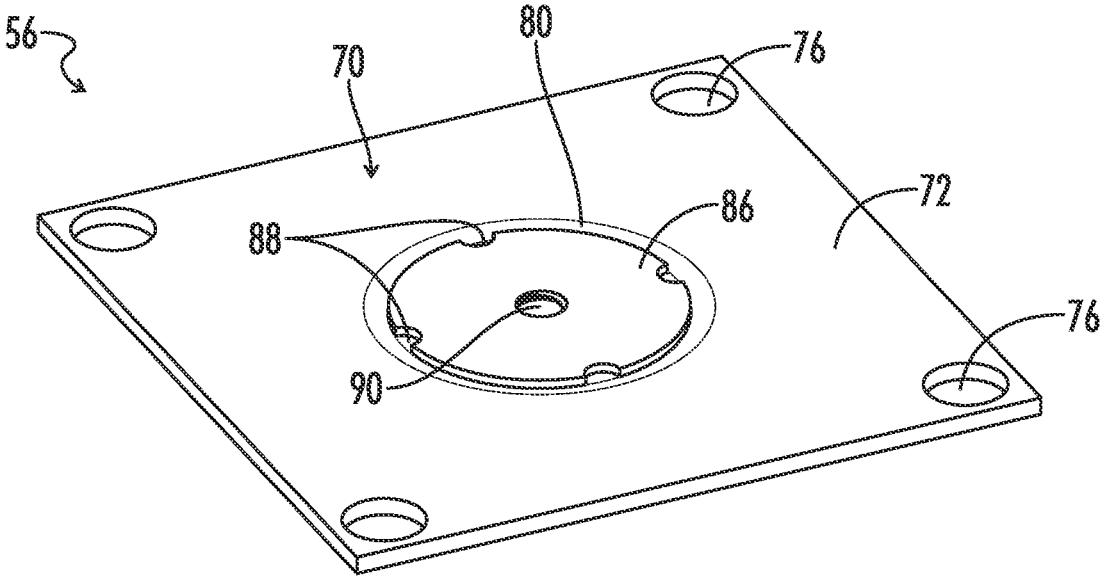
FIG. 5 is an isometric view of a shoe or cleat member component.
Figure 6:
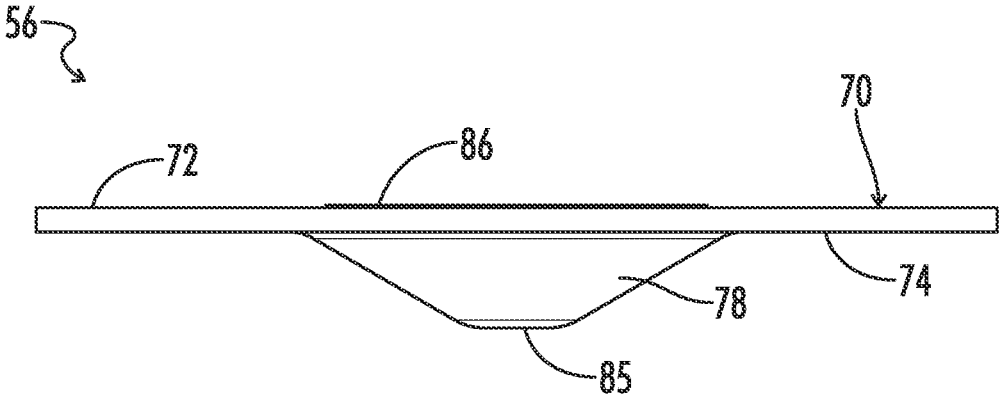
FIG. 6 is a side elevation view of the shoe or cleat member component.

FIGS. 5-6 illustrate the shoe or cleat member 56, which includes a plate 70 having, as oriented in the figures, an upwardly facing wall 72 and a downwardly facing wall 74. In some embodiments, plate 70 is a square steel plate having a 3/16th inch or less thickness and a width of five inches. One or more through-holes 76 extending between opposite walls 72 and 74 are also provided in plate 70 in a spaced apart relationship, preferably located near one the corners of plate 70. As shown in FIGS. 1 and 11, through-holes 76 are dimensioned to receive a standard 3/8th inch or 1/2 inch rebar 92 to secure the cleat member 56 to the pool shelf ground surface after the panel 20 has been properly positioned on the pool shelf or wall ledge in the manner described below. A recessed area or dimple is formed in upper wall 72 of plate 70, forming a corresponding downwardly cleat 78. The recessed area has a recessed peripheral lip 80, followed by downwardly angled inner wall 82 having an inner floor 83, forming a cavity 84, and also forming cleat 78 in bottom wall 74. The bottom wall 74 of shoe or cleat member 56 including lower end 85 of cleat 78 is preferably substantially smooth and is free of an any sharp or jagged edges. In an embodiment, end 85 is located at about 0.625 inches from upper wall 72 of plate 70. In another embodiment, end 85 is between about 1/2 inch and 3/4 inches from upper surface 72.

Shoe or cleat member 56 also includes a collar 86 which in an embodiment is secured over the upper wall 72 of plate 70 on peripheral lip 80 extending over cavity 84. In some embodiments, collar 86 is formed of the same or a lighter gauge steel than plate 70, and in one embodiment is comprised of 3/16th inch or less thickness steel. Several small cutouts 88 are provided in the peripheral edge of collar 86, which cutouts serve as locations for spot welding of the collar 86 to peripheral lip 80. In other embodiments, although less preferred collar 86 may be provided as a metal strap secured over cavity 84. A threaded hole 90 is centrally located in collar 86. As best shown in FIGS. 7 and 8, hole 90 is dimensioned to threadably receive shaft 59 of adjustment member 52, such that the lower end of shaft 59 can be threadably passed through collar 86 into cavity 84 of cleat member 56.

The manner of use of the leveling system 50 during construction of an in-ground swimming pool will now be described. Pool wall panels 20 used in forming a pool support wall (FIG. 12) may be provided in a variety of sizes, depending on the particular dimensions and configuration of the pool. All of such panels can be adapted for use of the leveling system 50, including all standard dimensioned panels, most commonly embodied in 2 foot, 3 foot, 4 foot, 5 foot, 6 foot, 7 foot, and 8 foot length panels, and all curved panels. As indicated above, the panels 20 in the illustrated embodiment have a series of similarly positioned apertures 44 and 46 on end flanges 32 and 34, such that the panels may be oriented when set on a pool shelf area with either flange 32 or 34 facing downwardly, wherein the downwardly facing flange 32 or 34 is effectively the bottom flange on which the leveling system 50 of the present invention is utilized, while the opposite end flange becomes the top flange.

The leveling system 50 is configured to be connected to the wall panel bottom flanges, which in the illustrated embodiment is flange 34, utilizing one or more of the apertures 44 and 46. During the manufacturing process or on a job site, as shown in FIG. 4 threaded fasteners 54 are secured in apertures 44 and 46 preferably with one fastener 54 located near each corner 36, 38 of the panels 20. Level adjustment member 52 is threadably secured to fastener 54 by passing the shaft 59 into internally threaded channel 60 starting from the inwardly facing surface of flange 34. Shoe or cleat member 56 is then positioned along the outer surface of flange 34, and shaft 59 of level adjustment member 52 is further rotated so as to be threadably inserted in internally threaded aperture 90 of collar 86 of cleat member 56. Shoe or cleat member 56 is now threadably attached to the outwardly facing or bottom surface of flange 34 of panel 20.

Figure 9A:
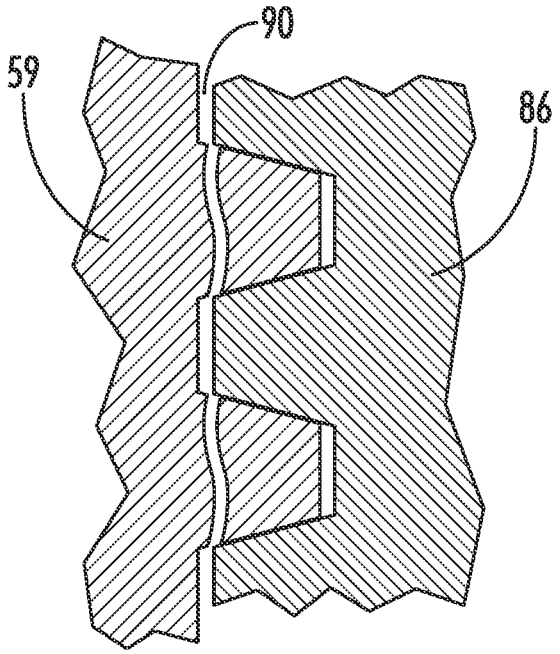
FIG. 9*a* is a schematic sectional view of the shoe or cleat member collar portion having a first thickness and illustrating the shearing of threads on the level adjustment member shaft.
Figure 9B:
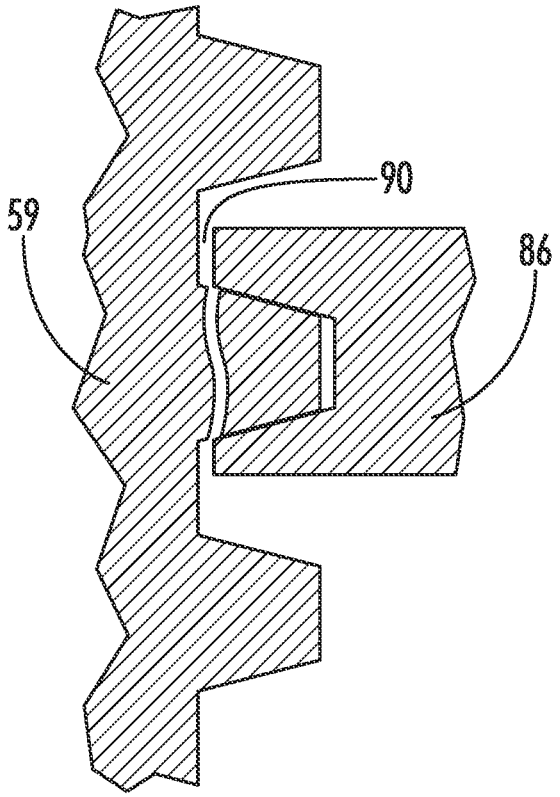
FIG. 9*b* is a schematic sectional view as in FIG. 9*a* with the shoe or cleat member collar portion having a second thickness.

To prevent cleat member 56 from inadvertently becoming detached from adjustment member 52 and therefore from flange 34 of panel 20 while using the system 50 to align, level, or square the pool walls, prior to use, as best shown in FIGS. 8, 9*a*, and 9*b*, shaft 59 is threadably rotated downwardly into cavity 84 until the lower end of the shaft 59 is forcibly pressing against inner floor 83 of the cavity 84. Shaft 59 is then still further forcibly rotated against inner floor 83, which additional downward force creates a similar upward force on the threads of shaft 59 in contact with threaded aperture 90 of collar 86, as well as on collar 86 due to its engagement with the threads of shaft 59. As indicated above, in some embodiments both plate 70 and collar 86 are made of 3/16th inch or less thickness steel, while in some embodiments, collar 86 is made of the same gauge or a lesser thickness steel as plate 70 and therefore has the same thickness or is thinner than plate 70. Furthermore, in one iteration adjustment member 52 is made of a lower grade steel than collar 86, so that the threads on shaft 59 of adjustment member 52 have a lesser shear stress or thread stripping strength than the threads of aperture 90 in collar 86. As a result, eventually the continued downward force of bolt shaft 59 against inner floor 83 of cleat 78 will increase to the point where such force is greater than the shear stress of the threads on shaft 59 of the level adjustment member 52. Once the force on the threads of shaft 59 surpasses their shear stress, as shown in FIGS. 9*a* and 9*b* the threads on shaft 59 of level adjustment member 52 in contact with the threads on aperture 90 of collar 86 will begin to shear or fracture. FIG. 9*a* illustrates collar 86 having a first width wherein more than one thread on shaft 59 is engaged with the threads of aperture 90 at the same time, while in FIG. 9*b* collar 86 has a second width wherein only one thread of shaft 59 is engaged with threaded aperture 90 of collar 86. In both instances, as a result of the broken or damaged threads on shaft 59, level adjustment member 52 will no longer accidentally become threadably disengaged from cleat member 56 while repositioning the wall panels 20 or during use of the invention to align, level, or square the wall panels 20, since as the level adjustment member 52 is turned it will simply rotate in cavity 84 of cleat 78, which remains stationary. In another embodiment, the threads on aperture 90 of collar 86 have a lesser shear stress than the threads on shaft 59 of the level adjustment member 52, such that the threads of aperture 90 will shear first while still preventing shaft 59 from threadably disengaging from the cleat member 56.

Peripheral lip or recessed area 80 in plate 70 on which collar 86 is received and spot welded to the plate 70 at the location of cutouts 88 is advantageous in that this allows the spot welds to be in closer proximity to the threaded aperture 90 as compared to other possible constructions of the shoe or cleat member 56, such as a strap secured to top surface 72 of plate 70 over cavity 84. Positioning the spot welds in close proximity to threaded aperture 90 aids in preventing the bolt shaft 59 from locking up in threaded aperture 90 before the threads are stripped by the forces exerted thereon as discussed above. In addition, this construction causes the threads of bolt 59 to strip more quickly because the collar 86 more tightly grabs the bolt.

In the illustrated embodiment, shoe or cleat member 56 is five inches square, which width is equal to the standard width of flanges 32 and 34 of wall panel 20. While the square shape and dimensions is believed to disperse the weight of the panels more efficiently, it will nevertheless be understood that the dimensions of the shoe or cleat member 56 can be varied. Plate 70 of cleat member 56 may, for example, have a diamond, star, rounded, triangular, or other shape while still working in the same manner and falling within the intended scope of the present invention. As shown in FIGS. 1 and 11, cleat members 56 of system 50 are attached to flange 34 by level adjustment member 52 such that the cleat member 56 is oriented with a corner portion of the plate 70 containing one of the apertures 76 extending out from under flange 34 along the rear surface 26 of the wall panels 20. This allows a piece of rebar 92 to be inserted downwardly through the aperture 76 into the pool shelf area (FIG. 2) to secure the cleat member 56 in place once the wall panel 20 has been properly positioned. Shoe or cleat 56 preferably will not stick out past the front surface 24 of the panel section, which could interfere with placement of the pool liner over the wall surface, although if it sticks out a small amount it can be bent out of the way after the footer is poured. As a result, the assembly, alignment, and leveling apparatus of system 50 therefore should be installed on flange 34 using an aperture 44 or 46 located closer to the rear edge of flange 34.

To use the assembly, alignment, and leveling system 50 of the present invention, a contractor would first affix cleat members 56 to flange 34 of each of the panels 20 in the manner just described, with threaded fasteners 54 either having been installed in apertures 44 and 46 of flange 34 before the panels are shipped to the contractor, or onsite by the contractor. The same process is repeated to affix each of the cleat members 56 to the panels 20 as needed. The system 50 is believed to be most effective if two cleat members 56 are attached to each panel 20 in a location near the opposite corners 36 and 38 of the flange 34 rather in the center, since this is the location where adjacent panels are joined, and thus is the heaviest and most rigid portion of the pool wall panels 20. As a result of the thread stripping process on level adjustment member 52 described above, the components of the system 50 are held in place on the flange 34 as the panels 20 are moved and arranged in an end-to-end relation to form the pool wall perimeter. In particular, the cleat or shoe members 56 will not become disconnected from the shaft 59 of the level adjustment member 52. When utilizing the alignment and leveling system 50 as part of a pool installation, the pool shelf area S on which the wall panels 20 are supported should be dug about an inch or two deeper than pool installations without the present invention in order to account for the additional space required for the shoe or cleat members 56 positioned between the panels and the shelf area. In one embodiment, the wall panels are forty-two inches tall, in which case the panel shelf should be dug to between about 43½ and 44 inches. Adjacent panels are then secured together via bolt fasteners 42 being passed through adjoining apertures 40 in the side flanges 28 and 30 of adjacent panels 20, which are secured by nuts 43. The panels 20 are constructed such that when adjacent panels are tightly secured together as just described, the panel walls are flush. However, since the pool shelf area S is usually somewhat rocky and uneven, when the panels 20 are initially placed on the shelf area S supported on cleat members 56, at least some of the panels are unlikely to be exactly straight or properly aligned, and therefore the side flanges 28 and 30 are usually not flush along the entire seam from top to bottom between side-by-side panels 20. As a result, the apertures 40 on the side flanges 28 and 30 are often not lined up properly and cannot be bolted together without requiring at least some additional repositioning of one or both adjacent panels. The present invention therefore may be operated to raise or lower one or both of the adjacent panels 20, or to raise or lower one side of a panel until both sides are vertically straight. A panel side can be easily raised or lifted by turning the level adjustment member 52 with respect to the threaded tubular fastener 54, which is connected to the panel 20, in a first direction which will cause the level adjustment member 52 to move downwardly in the tubular fastener 54 and the panel to move upwardly by increasing the distance between the bottom flange 34 and the shoe or cleat member 56. Similarly, a panel side can be lowered by turning the level adjustment member 52 in fastener 54 in a second opposite direction, which will cause the level adjustment member 52 to move upwardly with respect to the tubular fastener 54 and the panel side to move downwardly by decreasing the distance between the bottom flange 34 and shoe or cleat member 56. One or both panels 20 may be raised and/or lowered until the side flanges 28 and 30 are flush along their entire seam from top to bottom. In addition, the panels 20 may be slid or repositioned on the panel shelf S so they are properly aligned, which is made much easier by the shoe or cleat members 56 since cleat 78 will not dig into the shelf surface to the degree a nondimpled plate would due to the smooth and rounded bottom surface 78.

Once all of the pairs of side-by-side pool panels 20 have been properly aligned with flanges 28 and 30 of adjacent panels bolted together to construct a unitary wall, the contractor then must level and square the pool wall to ensure that all sides are perpendicular and properly aligned. While squaring the walls, it may again be necessary to reposition one or more panels or panel sections by sliding the panels laterally on the panel shelf S. Since the wall panel sections are being supported on the panel shelf on cleat members 56 of the present inventor's leveling system 50, even though adjacent panels are connected together the cleats 56 will slide on the panel shelf without significantly digging into and disturbing the panel shelf, which could lead to future settling of the wall. As shown in FIG. 6, the lower surface 74 of the cleats 56 including rounded cleat 78 is generally smooth. Thus, while the weight of the wall will generally prevent the panels from sliding on their own, cleat 78 is relatively shallow, and the smooth and rounded underside allows the cleat or foot member 56 and panels to be moved laterally a short distance relatively easily using only a manual force or a light tapping or hammering action. In comparison, conventional foot members contain a plurality of downwardly facing jagged tooth members which are intended to dig into the ground in order to provide as strong a grip as possible with the ground surface. Surprisingly, however, the inventor has discovered that providing a relatively shallow dimple 85 on the bottom of cleat 56 still provides a sufficient grip with the panel shelf surface S but has the significant additional benefit of still allowing the connected panel sections to be pushed, slid, or otherwise moved laterally during squaring and aligning of the panels.

Once properly squared and aligned, a rebar is then passed through one of the apertures 76 in plate 70 of cleat members 56 to secure devices 50 and as a result also the panels against lateral movement or bowing in and out until the cement footer is poured. After the rebar is set in apertures 76, the pool wall formed by the connected panels 20 can be leveled utilizing the leveling system 50 of the present invention. A contractor will now use a 9/16th inch socket, cordless drill, impact wrench or similar tool to raise or lower individual sections of the panel walls to a benchmark height by turning the level adjustment member 52 either clockwise or counterclockwise as it presses against the inner floor 83 of shoe or cleat 56, which in turn is pressing against the dirt surface of the panel shelf S on which the pool wall is supported. Since adjacent panels are tightly secured together, adjusting the height along an edge of one of the panels will also simultaneously adjust the height of one or more adjacent panels. As a result, the leveling system 50 can be used to raise or lower sections of the pool wall made up of multiple panels at one time rather than having to level each panel individually. Once the entire pool wall has been properly leveled, additional rebar 92 may also then be passed through one or more of the unused apertures 44 or 46 in flange 34 of the panels 20 to further secure the panels in place. Placement of rebar 92 in the apertures 44, 46 in flange 34 before the panels are leveled is likely to inhibit the raising or lowering of the panel, particularly if the rebar was inserted in the aperture at an angle. Another significant advantage of the present system 50 is that by inserting rebar through the apertures 76 in shoe or cleat member 56, the position of the panels on the panel shelf can still be maintained during the leveling process, which is not achievable using conventional leveling processes known to the present inventor.

Another advantage of embodiments of the assembly, alignment, leveling and squaring system 50 is that since shaft 59 of the level adjustment member 52 is not threadably connected to internally threaded aperture 90 of collar 86 of the cleat members 56, the cleat members 56 are able to tilt or pivot with respect to stationary shaft 59 within a range of about thirty degrees, and therefore also with respect to the panel flanges 34. The cleat members 56 therefore are enabled with a ball joint effect with respect to the shaft 59, which allows the cleat members 56 to pivot or swivel if the wall shelf has a slight angle, enabling a greater surface area of the bottom surface 74 of the cleat members 56 to be in physical contact with the wall shelf ground surface.

In one method for leveling a pool wall, using appropriate measuring equipment a contractor will determine the highest point on the entire pool wall, which will then be used as a benchmark height for the pool wall. Then, using the inventor's apparatus and system 50 all sides of the pool wall will be raised to the benchmark height, after which the other sections are adjusted to be level with the benchmark height. It will be understood of course that points other than the highest point may be utilized as a reference point or benchmark in leveling the pool wall. In the illustrated embodiment, level adjustment member 52 of the system 50 has been described as having a length of six inches. Therefore, the contractor has in effect a six-inch variance to raise or lower the panels 20. The cleat member 56 will not become detached or unthreaded from the level adjustment member 52 as the wall panel is raised because as described above a short section of the threads on shaft 59 have been intentionally damaged or sheared, so that under normal use conditions shaft 59 of adjustment member 52 will not threadably disengage from aperture 90 of collar 86. Once the entire wall has been properly levelled, a cement footer typically having a thickness of about eight inches is poured on the panel shelf in the area behind the wall panels, immersing the levelling system, bottom plate and the ground area behind the wall in cement. The cement will naturally fill any spaces under the bottom flange of the wall that may form due the wall being lifted by the leveling system. The pool installation process will then proceed according to the usual steps.

Figure 12:
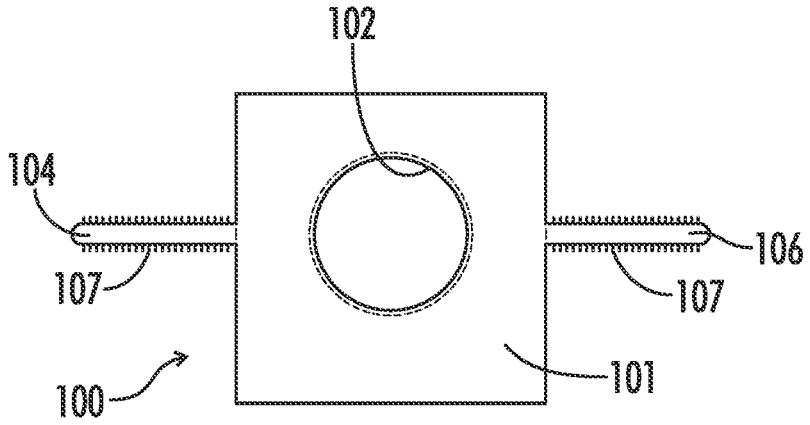
FIG. 12 is a top view of an alternative tabbed threaded fastener component with the tabs in a flat position.
Figure 13:
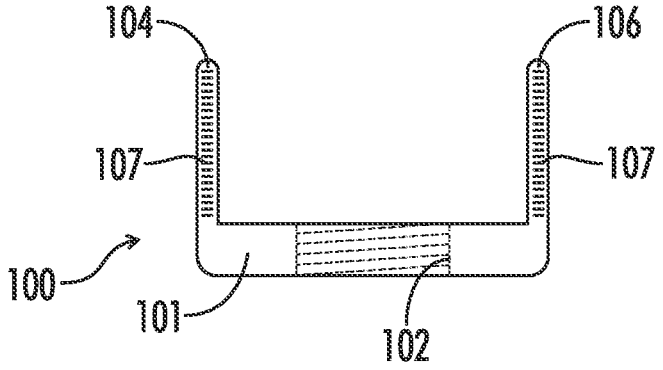
FIG. 13 is a side view of the tabbed threaded fastener shown in FIG. 12 with the tabs in a bent position.
Figure 14:
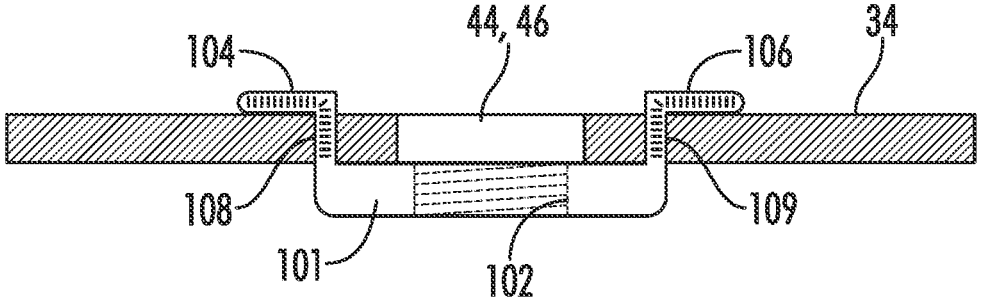
FIG. 14 is an elevation view of the tabbed threaded fastener in FIGS. 12 and 13 attached to a pool wall panel bottom flange.

FIGS. 12-14 illustrate an internally threaded fastener 100 which can be utilized as an alternative to tubular fastener 54 in accordance with the present invention. Fastener 100 in an embodiment is a square nut having a body section 101, which in the illustrated embodiment is 2 inches square and ¼ inches thick. A threaded through-hole 102 having SAE standard threads is centered extending laterally in body section 101. In addition, a pair of bendable tabs 104 and 106 extend from opposite side surfaces of the body section 101. In the illustrated embodiment, the tabs 104 and 106 are 1½ inches in length. In addition, a plurality of barbs 107 are provided on outer surface of the tabs 104 and 106. In order to use the alternate fastener 100, in an embodiment the end flanges 32 and 34 of the wall panels 20 are provided with two additional holes 108 and 109, which are located evenly spaced on opposite sides of one of the apertures 44 and 46 on flanges 32 and 34. Apertures 108 and 109 are smaller than apertures 44 and 46 and are dimensioned to receive the barbed tabs 104 and 106 on fastener 100. The decision as to which of the apertures 44 to have the two smaller holes 108 and 109 punched beside it in an embodiment will be made by the factory; however, as in FIG. 1 it is recommended in panels having a series of three holes 44 and 46 in the corners of the end flanges 32 and 34 that the middle be selected to have the smaller holes 108 and 109 punched beside them. Use of the middle aperture allows the leveling system to set back further in the dirt, which is useful where the ground dirt in panel shelf location to support the wall panel is uneven or beveled. In other embodiments, the holes 108 and 109 can be selectively punch in the bottom flange in the desired location by the contractor on a jobsite.

To install and use the leveling system with alternate fastener 100, a contractor would first affix the fastener 100 to the bottom or outer surface of the bottom flange 34 by inserting each of the barbed tabs 104 and 106 of the securing member 100 into one of the holes 108 and 109 from the outer or bottom facing surface of the flange 34. As shown in FIG.

14, once the barbed tabs 104 and 106 are inserted into holes 108 and 109, respectively, the ⅜th inch threaded aperture 102 in securing member 100 will be automatically aligned with the ½ inch hole 44 or 46 positioned between the tab receiving holes 108 and 109. The tabs 104 and 106 should then bent outwardly over the inwardly facing surface of flange 34 to provide a secure fit of the body portion 101 to the bottom surface of flange 34. Once the fastener 100 is secured to the bottom surface of flange 34 of the panel 20, the threaded shaft section 59 of level adjustment member 52 passed through the ½ inch hole 44 or 46 in flange 34 from the inwardly facing surface of flange 34 and into the threaded aperture 102 of fastener 100. As in the previously described embodiment, the level adjustment member 52 is threaded downwardly until the lower end of the shaft section 59 extends out the lower facing end of aperture 102 in the fastener 100 a sufficient distance for the shoe or cleat 56 to be secured to shaft section 59 also in the manner described above. In an embodiment, rather than having a threaded aperture 90, the cleat will contain short tabs located on the peripheral rim of the recessed area or dimple which will catch of the threads of the shaft section 59 to secure the adjustment member 52 to the cleat or shoe 56.

The presently described apparatus, system, and method 50 is simple to use and install since it only includes three component parts, and enables swimming pool contractors to more quickly and accurately assemble, align, level, and square an in-ground panel system pool wall. Prior art methods of leveling panel-constructed pool walls generally require the use of a pry bar to lift the wall, and then insert a shim between the ground surface and bottom plate of the wall section. This process is repeated around the entire perimeter, which for an average size pool can take about an hour or a little more. In contrast, leveling the same pool if fitted with the assembly, aligning, leveling, and squaring system of the present invention, the leveling process would take only about ten to fifteen minutes, and no more than twenty minutes. In addition, as discussed above the process of assembly, squaring, and aligning the pool wall prior to leveling is also made easier using the present invention by enabling the lateral position of one or more wall sections to be adjusted more easily.

The pool construction and installation process is further improved by the present invention due to the provision of a cleat or foot member that will not become disconnected or detached from the threaded bolt shaft 59 and therefore from the bottom flange of the panels, either during initial handling and positioning of the panels on the panel shelf, or during raising and lowering of the panels during assembly and leveling of the entire pool wall. In particular, the threads on the bolt shaft 59 are stripped at a location about ½ to ¾ inches spaced apart from the lower end of the bolt shaft. As a result, the lower end of the shaft extends downwardly into the cavity formed by the dimple in the shoe or cleat member, and is in physical contact with the inner floor of the dimple. This provides excellent support for the panel on the bolt shaft 59 and resultingly also on the shoe or cleat member. The present inventor's system is essentially foolproof in that when the bolt shaft is rotated in a direction that would otherwise cause it to unthread from the threaded aperture in the collar if rotated far enough, due to the fractured threads it just spins, while the panel is lowered with respect to the cleat member. The threaded fastener will not strip. If the contractor has to lower the wall, when the bolt shaft is turned it will stay attached to the panel through the threaded fastener, pulling the panel up through the threaded fastener. The dimple in the plate allows enough of the bolt to be underneath the collar so that if a worker accidentally leaves an impact wrench on reverse, the stripped threads are followed by enough good threads to hang on to the shoe or cleat at the aperture 90, so the bolt shaft won't continue up through the threaded fastener. Where the bottom of the panel is moved to a position flush with the upper surface of the shoe or cleat member, the stripped threads on the bolt will hit the bottom of the rivnut, and the bolt shaft will not unthread any further. In addition, the shoe or cleat member once positioned and secured to the pool shelf will remain stationary. When an impact wrench is on reverse, the panel will drop down, and if the threads are pre-stripped at a location at least ½ to ¾ inches up the bolt shaft, this will prevent the shoe or cleat member from coming off the bolt shaft.

While the present invention has been described at some length and with some particularity with respect to the several described embodiments, it is not intended that it should be limited to any such particulars or embodiments or any particular embodiment, but it is to be construed with references to the appended claims so as to provide the broadest possible interpretation of such claims in view of the prior art and, therefore, to effectively encompass the intended scope of the invention. As used throughout, ranges are used as shorthand for describing each and every value that is within the range. Any value within the range can be selected as the terminus of the range.

What is claimed is:

1. An apparatus used for assembling, aligning, leveling, and squaring in-ground pool wall panels during pool construction comprising:

an adjustment member having an at least partially externally threaded shaft section, said shaft section having a lower end and a longitudinal axis;

a fastener securable to a lower flange of a pool wall panel, the fastener having an internally threaded aperture adapted to rotatably receive the threaded shaft section of the adjustment member; and a cleat member adapted to be connected to the threaded shaft section of the adjustment member in a position to support the pool wall panel on a ground surface, the cleat member having opposite side walls, a through-hole extending between the opposite side walls and configured to receive a rebar, a cleat portion formed in one of the opposite side walls, the cleat portion having a rounded ground-engaging surface and defining a cavity in the side wall of the cleat member opposite the cleat portion, the cavity having an inner floor, a collar portion connected directly to the cleat member extending over the cavity, and an aperture in the collar portion positioned over the cavity, the aperture adapted to receive the threaded shaft section of the adjustment member with the lower end in physical contact with the inner floor of the cavity to support the pool wall panel on the cleat member, said cleat member being attached to the adjustment member so as to be both rotatable in a 360 degree range about the longitudinal axis of the threaded shaft section and pivotable laterally relative to said longitudinal axis;

wherein rotation of the adjustment member relative to the fastener in a first direction will raise the pool wall panel relative to the ground surface and rotation of the adjustment member relative to the fastener in a second direction will lower the pool wall panel relative to the ground surface.

2. The apparatus of claim 1 wherein at least one in-ground pool wall panel assembling, aligning, leveling, and squaring apparatus is secured to the lower flange of each of the pool wall panels forming a pool wall.

3. The apparatus of claim 1 wherein the cleat member is pivotable laterally relative to the longitudinal axis of the threaded shaft section within a predetermined range of about thirty degrees to facilitate proper placement on an uneven ground surface.

4. The apparatus of claim 3 wherein the internally threaded fastener is securable in a hole formed in the lower flange of the pool wall panel.

5. The apparatus of claim 4 wherein the side wall of the cleat member containing the cleat portion is substantially smooth.

6. The apparatus of claim 3 further comprising a recessed lip formed in the side wall of the cleat member opposite the cleat portion and extending around the cavity, said collar portion secured directly to the recessed lip.

7. The apparatus of claim 3 wherein the aperture in the collar portion of the cleat member is internally threaded and is adapted to threadably receive the externally threaded shaft section of the adjustment member, and wherein threads on the externally threaded shaft section of the adjustment member have a first shear stress, and threads on the internally threaded aperture in the collar portion have a second shear stress, said first shear stress being less than said second shear stress.

8. The apparatus of claim 7 wherein upon a shearing force greater than the first shear stress but less than the second shear stress being applied to a threaded connection between the externally threaded shaft section of the adjustment member and internally threaded aperture in the collar portion, one or more of the threads on the externally threaded shaft section of the adjustment member forming part of said threaded connection are sheared, securing the cleat member against rotatably disengaging from the shaft section of the adjustment member when the adjustment member is rotated relative to the fastener to adjust a vertical height of the wall panel, and enabling the cleat member to rotate or pivot laterally with respect to the longitudinal axis of the adjustment member within said predetermined range.

9. The apparatus of claim 3 wherein the aperture in the collar portion is internally threaded and is adapted to threadably receive the externally threaded shaft section of the adjustment member, the threads on the threaded shaft section of the adjustment member have a first shear stress, and the threads on the internally threaded aperture in the collar portion have a second shear stress, and wherein said second shear stress is less than said first shear stress.

10. The apparatus of claim 9 wherein when a shearing force greater than the second shear stress is applied to a threaded connection between the externally threaded shaft section of the adjustment member and internally threaded aperture in the collar portion, one or more threads on the internally threaded aperture in the collar portion forming said threaded connection are sheared, securing the cleat member against rotatably disengaging from the shaft section of the adjustment member when the adjustment member is rotated relative to the fastener to adjust a vertical height of the wall panel, and enabling the cleat member to rotate or pivot laterally with respect to the longitudinal axis of the adjustment member within said predetermined range.

11. The apparatus of claim 1 further comprising a plurality of said through-holes formed in the cleat member configured to receive a rebar.

12. The apparatus of claim 1 wherein the cleat member is about five inches square.

13. A pool wall panel assembly, alignment, leveling, and squaring apparatus including a cleat member, an adjustment member, and an internally threaded fastener, wherein the internally threaded fastener is adapted to be attached to a lower flange of a pool wall panel and a shaft section of the adjustment member is adapted to be threadably connected to the internally threaded fastener, the cleat member comprising:

a plate member having opposite side walls, one or more through-holes defined in the plate member adapted for receiving a ground stake therethrough, a cleat disposed on one of the side walls and having a rounded ground-engaging surface, a corresponding cavity formed in the opposite side wall having an inner wall surface; and a collar coupled directly to the plate member extending over the cavity, the collar having an aperture opening into the cavity adapted to receive the shaft section of the adjustment member with a lower end of the shaft section of the adjustment member in contact with the inner wall surface of the cavity, said cleat member coupled to the shaft section of the adjustment member so as to be rotatable about an axis of the shaft section within a range of 360 degrees and pivotable laterally relative to said axis.

14. The cleat member as in claim 13 further comprising internal threads on the aperture in the collar, and external threads on the shaft section of the adjustment member are adapted to threadably couple with the internal threads on the aperture in the collar, said threads on the internally threaded aperture in the collar having a greater shear strength than said threads on the shaft section of the adjustment member such that a shearing force applied to the threadably engaged threads on the shaft section of the adjustment member and aperture in the collar by rotating the adjustment member in a first direction until the outer end of the shaft section is pressing in contact with the inner wall surface of the cavity with a force that exceeds the shear strength of the external threads on the shaft section of the adjustment member but does not exceed the shear strength of the internal threads on the aperture in the collar, one or more of the external threads on the shaft section threadably engaged with the internal threads on the aperture in the collar will fracture, securing the cleat member against being threadably disengaged from the shaft section of the adjustment member when the adjustment member is rotated relative to the fastener to adjust a vertical height of the pool wall panel, and enabling the cleat member to pivot laterally with respect to the axis of the shaft section of the adjustment member.

15. The cleat-like member as in claim 13 further comprising internal threads on the aperture in the collar, wherein the external threads on the shaft section of the adjustment member are adapted to threadably engage the internal threads on the aperture in the collar, the internal threads on the aperture having a lesser shear strength than the external threads on the shaft section of the adjustment member, such that when the shaft section of the adjustment member is threadably received in the aperture in the collar and a shearing force is applied to the engaged threads of the shaft section of the adjustment member and aperture in the collar that exceeds the shear strength of the threads of the aperture in the collar but does not exceed the shear strength of the threads on the shaft section of the adjustment member, one or more of the engaged threads on the aperture in the collar will fracture, securing the cleat member against being threadably disengaged from the shaft section of the adjustment member when the adjustment member is rotated relative to the fastener to adjust a vertical height of the pool wall panel, said cleat member being pivotable laterally with respect to the shaft section of the adjustment member within a range of about 30 degrees to accommodate placement of the cleat member on an uneven ground surface.

16. The cleat member as in claim 13 wherein the cleat has a smooth outer surface to facilitate lateral sliding of the cleat member on a ground surface.

17. A pool wall panel assembly, alignment, leveling, and squaring apparatus including a cleat member, an adjustment member, and an internally threaded fastener, said internally threaded fastener being secured to a lower flange of a pool wall panel, a shaft section of the adjustment member being rotatably connected to the internally threaded fastener, and the cleat member being connected to the adjustment member and supporting the pool wall panel assembly on a ground surface, the cleat member comprising:

a plate member having a upper wall and a bottom wall, one or more through-holes defined in the plate member adapted for receiving a ground stake therethrough, a cleat formed in the bottom wall having a rounded ground-engaging wall surface, a cavity formed in an interior of the cleat member, an aperture in the upper wall connecting into the cavity and being adapted to receive an outer end of the shaft section of the adjustment member into the cavity supported on a floor of the cavity, said cleat member being coupled to the shaft section of the adjustment member along an outer surface of the lower flange of the pool wall panel and being rotatable about an axis of the shaft section of the adjustment member and pivotable within a range of at least 30 degrees with respect to the axis of the shaft section of the adjustment member to accommodate uneven areas of the ground surface.

18. The cleat member as in claim 17 further comprising internal threads on the aperture in the upper wall, wherein external threads on the shaft section of the adjustment member are adapted to threadably engage the internal threads on the aperture in the collar, said threads on the internally threaded aperture in the collar having a greater shear strength than said threads on the shaft section of the adjustment member such that a shearing force applied to the threadably engaged threads on the shaft section of the adjustment member and aperture in the collar by rotating the adjustment member in a first direction until the outer end of the shaft section is pressing in contact with the floor of the cavity with a force that exceeds the shear strength of the external threads on the shaft section of the adjustment member but does not exceed the shear strength of the internal threads on the aperture in the collar, one or more of the external threads on the shaft section engaged with the internal threads on the aperture in the collar will fracture, securing the cleat member against being threadably disengaged from the adjustment member when the adjustment member is rotated relative to the fastener to adjust a vertical height of the pool wall panel.

19. The cleat-like member as in claim 17 further comprising internal threads on the aperture in the collar, wherein the external threads on the shaft section of the adjustment member are adapted to threadably engage the internal threads on the aperture in the collar, the internal threads on the aperture having a lesser shear strength than the external threads on the shaft section of the adjustment member, such that when the shaft section of the adjustment member is threadably received in the aperture in the collar and a shearing force is applied to the engaged threads of the shaft section of the adjustment member and aperture in the collar that exceeds the shear strength of the threads of the aperture in the collar but does not exceed the shear strength of the threads on the shaft section of the adjustment member, one or more of the engaged threads on the aperture in the collar will fracture, securing the cleat member against being threadably disengaged from the shaft section of the adjustment member when the adjustment member is rotated relative to the fastener to adjust a vertical height of the pool wall panel.

20. A method of securing a cleat member of a pool wall assembly, alignment, squaring, and leveling apparatus to a pool wall panel, comprising:

providing a fastener having an internally threaded aperture;

securing the fastener to a bottom flange of the pool wall panel at a desired location;

providing an adjustment member having a head section and a threaded shaft section;

threadably passing the threaded shaft section of the adjustment member into the threaded aperture of the fastener from an inwardly facing surface of the bottom flange of the pool wall panel by rotating the adjustment member in a first direction;

providing a cleat member including a plate having at least one through-hole in the plate dimensioned to receive a rebar, a cleat formed in a side wall of the plate for engaging a ground surface, a cavity defined in an opposite side wall of the plate, and a collar attached directly to the plate and positioned extending over the cavity, the collar having a threaded aperture adapted to threadably receive an outer end of the threaded shaft section of the adjustment member within the cavity, wherein the threads on the threaded shaft section of the adjustment member have a lesser shear stress than the threads on the threaded aperture in the collar;

threadably engaging the outer end of the threaded shaft section of the adjustment member with the threaded aperture in the collar by rotating the adjustment member in the first direction; and applying a shearing force on a threaded connection between the threaded shaft section of the adjustment member and threaded aperture by continuing to rotate the adjustment member in the first direction until the outer end of the shaft section is pressing against an inner wall surface of the cavity with a sufficient force to cause one or more threads on the threaded shaft section of the adjustment member in contact with the threads in the aperture in the collar to shear as a result of said force, rotatably and pivotably securing the cleat member to the shaft section.

* * * * *